US008231239B2

(12) United States Patent
Hickey

(10) Patent No.: US 8,231,239 B2
(45) Date of Patent: Jul. 31, 2012

(54) PORTABLE ILLUMINATED DISPLAY DEVICE

(76) Inventor: Terrence Peter Hickey, Port Hope (CA)

( * ) Notice: Subject to any disclaimer, the term of this patent is extended or adjusted under 35 U.S.C. 154(b) by 234 days.

(21) Appl. No.: 12/874,165

(22) Filed: Sep. 1, 2010

(65) Prior Publication Data

US 2011/0051399 A1 Mar. 3, 2011

Related U.S. Application Data

(60) Provisional application No. 61/239,066, filed on Sep. 2, 2009.

(51) Int. Cl.
*G09F 13/08* (2006.01)
*F21V 21/096* (2006.01)
*F21V 23/04* (2006.01)

(52) U.S. Cl. ..... 362/97.4; 362/109; 362/382; 362/394; 362/398; 362/604; 40/575; 40/716

(58) Field of Classification Search ..... 362/97.4, 362/109, 382, 394, 398, 602, 604, 605; 40/546, 40/564, 575, 714, 716
See application file for complete search history.

(56) References Cited

U.S. PATENT DOCUMENTS

| | | | | |
|---|---|---|---|---|
| 3,356,839 | A * | 12/1967 | Mineo et al. | 362/604 |
| 5,130,907 | A * | 7/1992 | Tortola et al. | 362/109 |
| 5,265,357 | A * | 11/1993 | Yu | 40/714 |
| 5,718,498 | A * | 2/1998 | Pullman | 362/602 |
| 5,943,801 | A * | 8/1999 | Wilkinson | 40/564 |
| 6,575,596 | B2 * | 6/2003 | Butt | 362/259 |
| 7,186,015 | B2 * | 3/2007 | Kimmet et al. | 362/630 |
| 7,883,252 | B2 * | 2/2011 | Matsui et al. | 362/612 |
| 7,942,542 | B1 * | 5/2011 | Dunn | 362/97.3 |
| 2007/0113455 | A1 * | 5/2007 | Chua | 40/714 |
| 2010/0088941 | A1 * | 4/2010 | Zhu | 40/714 |

* cited by examiner

*Primary Examiner* — Alan Cariaso
(74) *Attorney, Agent, or Firm* — Michael Ries

(57) ABSTRACT

The present invention is a portable illuminated display device. The device includes a plurality of light emitting diodes (LEDs) that provide light to the device, a substrate that is lit by the LEDs, a plurality of batteries that power the display, an image that includes a message or other indicia and a color insert that can change the LEDs light color. The device also includes a core with an electronics component, a light panel that receives the light from the LEDs and provides a homogenous area of light, a cover with a cover surface, a casing with a back lid, a front lid and an opening between the lids, a vertical and horizontal attachment point, a on and off push button and a metal plate and a plurality of magnets to allow a user to attach the device.

20 Claims, 4 Drawing Sheets

PORTABLE ILLUMINATED DISPLAY DEVICE

This application claims priority to U.S. Provisional Application 61/239,066 filed on Sep. 2, 2010, the entire disclosure of which is incorporated by reference.

TECHNICAL FIELD $ BACKGROUND

The present invention generally relates to an illuminated display device. More specifically, the invention is a portable illuminated display device.

It is an object of the invention to provide a portable illuminated display device that provides a backlit display for any image that you wish to show in a dimly lit or very dark area.

What is really needed is a portable illuminated display device that provides a backlit display for any image that you wish to show in a dimly lit or very dark area in a wide variety of settings where illumination of an image is required or advantageous, such as a name tag, advertisement, sign or security or safety identifier.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
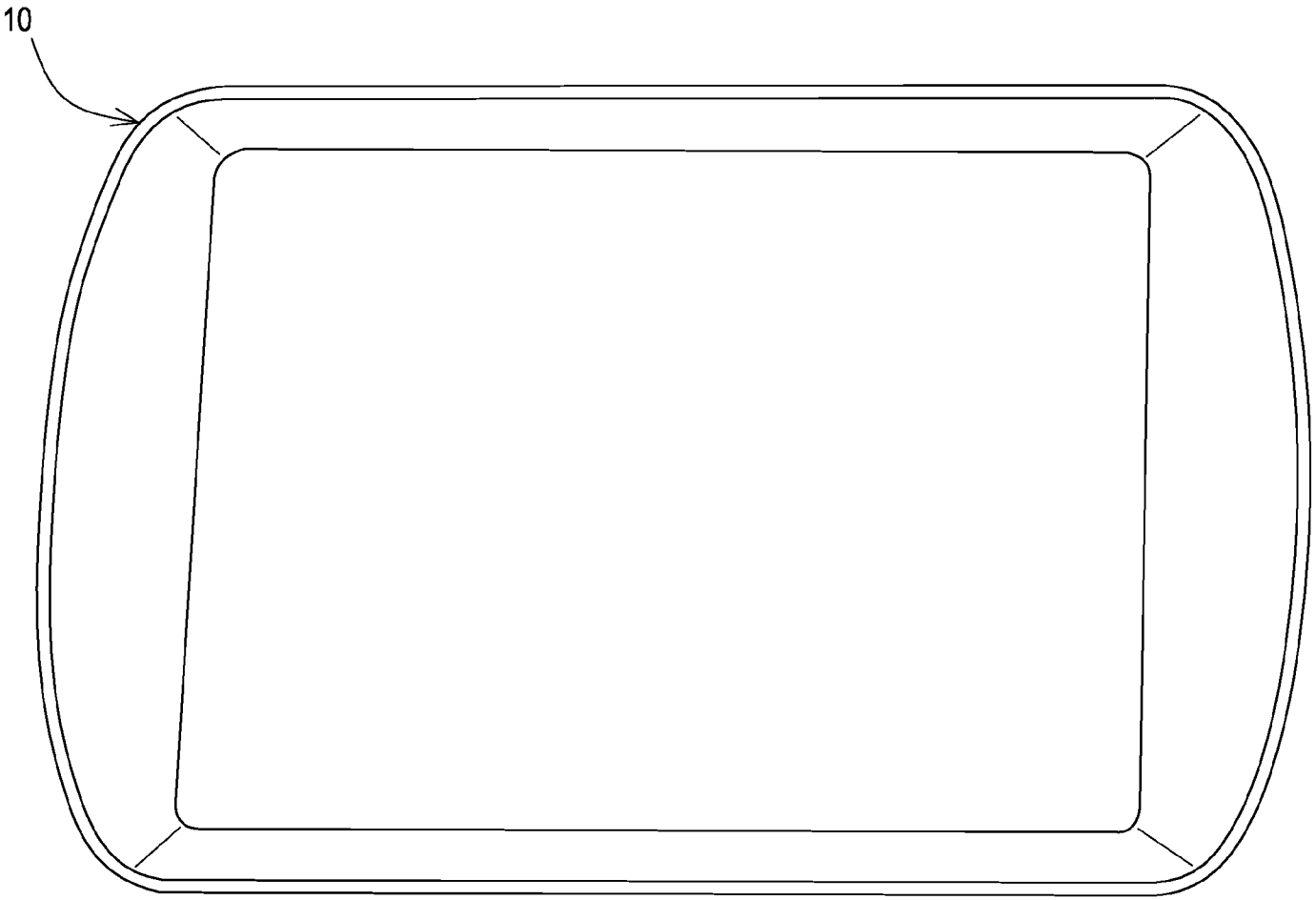
FIG. 1A illustrates a diagonal front perspective view of a portable illuminated display device, in accordance with one embodiment of the present invention.

FIG. 1A illustrates a diagonal front perspective view of a portable illuminated display 10, in accordance with one embodiment of the present invention. The portable illuminated display 10 is fully assembled with its entire component parts, which are further discussed in greater detail in FIG. 1B.

Figure 1B:
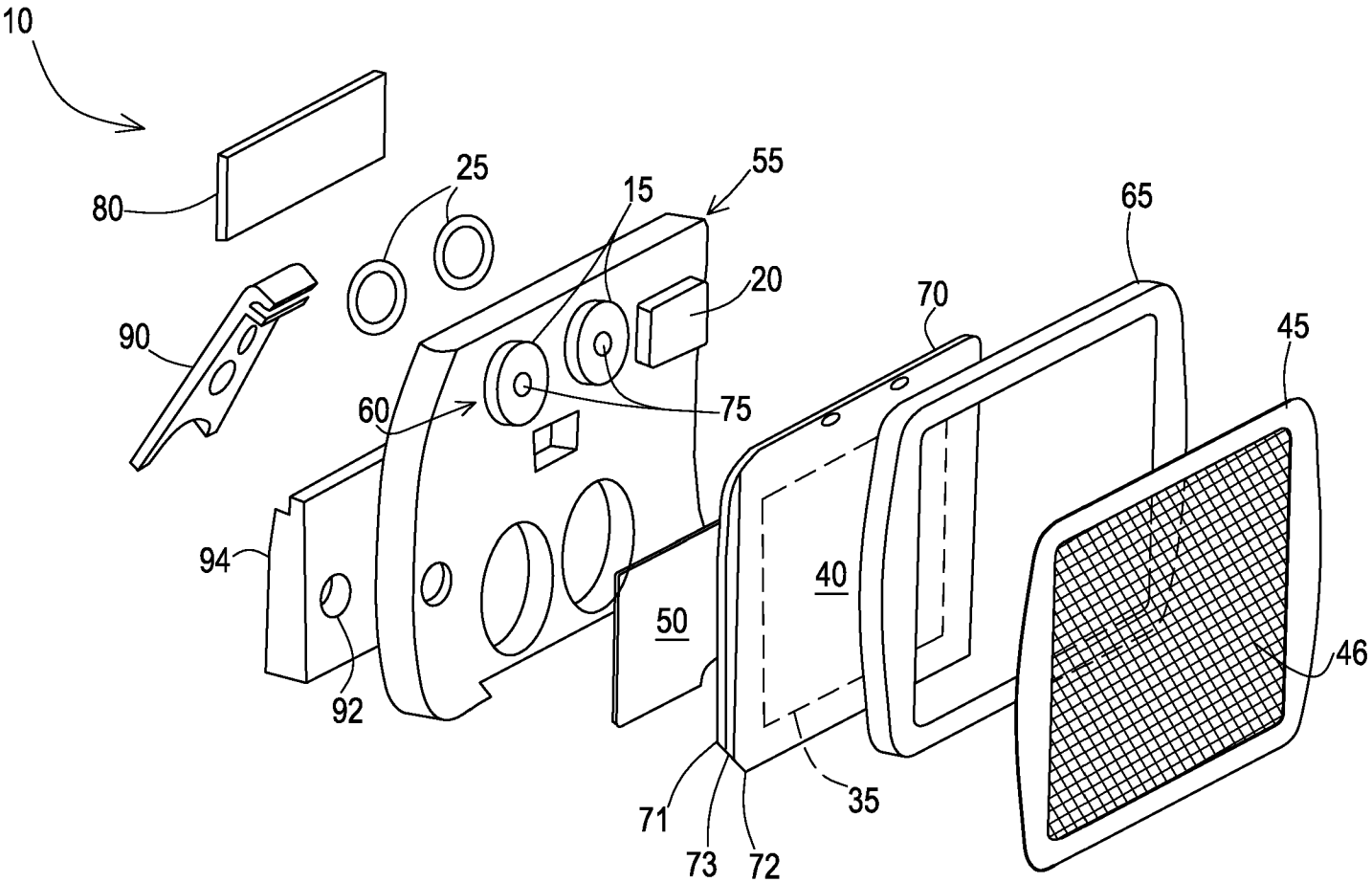
FIG. 1B illustrates a front side perspective view of a portable illuminated display device, in accordance with one embodiment of the present invention.
Figure 1C:
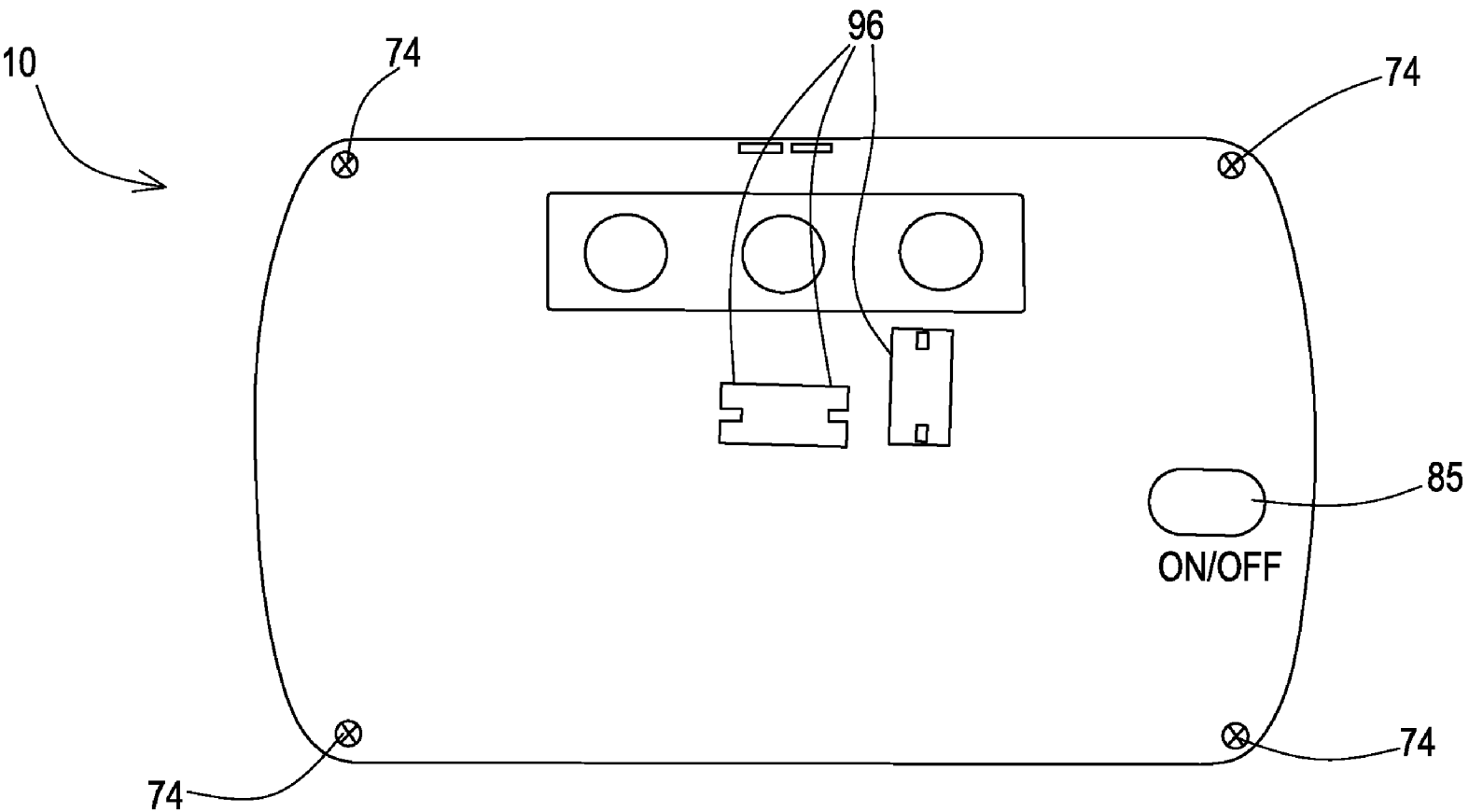
FIG. 1C illustrates a rear perspective view of a portable illuminated display device, in accordance with one embodiment of the present invention.
Figure 1D:
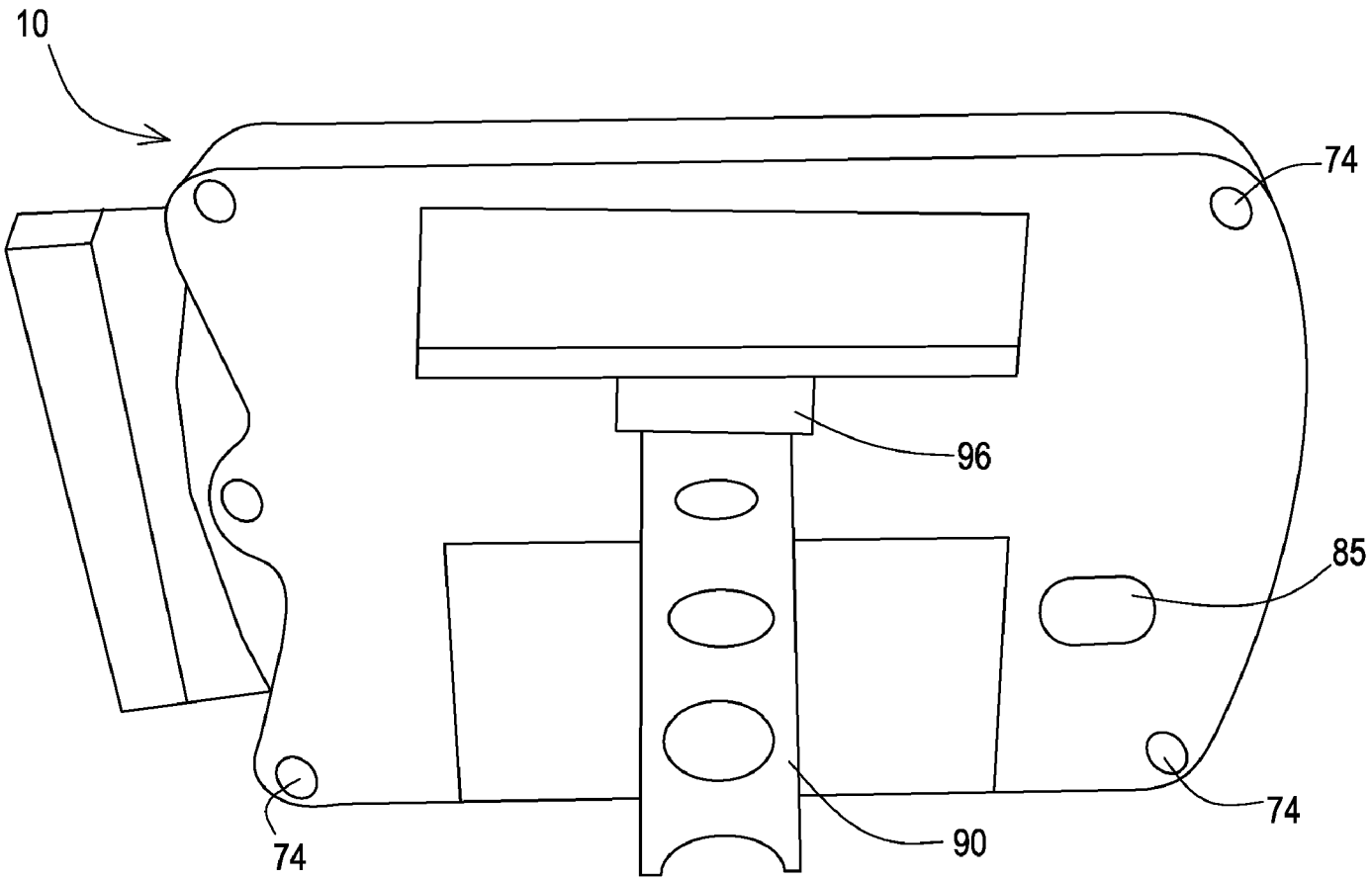
FIG. 1D illustrates a rear perspective view of an attached easel for a portable illuminated display device, in accordance with one embodiment of the present invention.

FIG. 1B illustrates a front side perspective view of a portable illuminated display 10, in accordance with one embodiment of the present invention. FIG. 1C illustrates a rear perspective view of a portable illuminated display device 10, in accordance with one embodiment of the present invention. FIG. 1D illustrates a rear perspective view of an attached easel 90 for a portable illuminated display device 10, in accordance with one embodiment of the present invention.

The portable illuminated display 10 is a device with a number of light emitting diodes LED's 15 that light a substrate 20. The LEDs 15 can be several sizes, one of which will be about the same surface area as a credit card. The portable illuminated display 10 is operated with 2 coin cell batteries 25 and provides a backlit display for any image that is desired to be shown in a dimly lit or very dark area. The portable illuminated display device 10 can be powered by either button cell batteries, direct AC or a rechargeable battery module. One embodiment has 2 button cell batteries, but other power sources that are well known in the art can also be used.

With white LEDs 15, the portable illuminated display 10 can be used to display any image in color, although any color LED that is well known in the art can be used. While backlit displays are common in large formats such as billboards or signs in theaters, the portable illuminated display 10 can be used in a relatively smaller personal space such as when worn or used on a table top, for example.

The portable illuminated display 10 can receive an image 35 that has a message or other indicia 40 and by being backlit, can be seen in dim light and can create a focal point. The portable illuminated display 10 works by simply inserting an image 35 into the unit under the top lid or cover 45. The image 35 lies above the light plate 65 and is therefore backlit. The image 35 can either then be removed and replaced with another image 35 or affixed permanently. In one embodiment, a color insert 50 can be used to change the LED 15 from white color to any other desired color. A user can also write for example, with a dry erase marker, on the lid or cover surface 46 to convey a simple message as well.

The portable illuminated display device 10 also includes a core 55 with electronics components 60 and a light panel 65. The electronics components 60 have an integrated circuit (not shown) that allows two light levels to be used for the plurality of LED's 15. This is controlled by an ON/OFF button 85 on the back of the casing 70 of the portable illuminated display 10. The light panel 65 is a pixilated piece of plastic that allows the light to hit it and bounce all around the light plate 45, providing a homogenous area of light. The sides and back of the light panel 65 are covered with a Mylar™ style material to ensure that light does not escape from the light panel 65 other than directly from the front where it is needed. The light panel 65 however, can be covered or be made of any material that is well-known to those schooled in the art. The casing 70 consists of a back lid 71 and a front lid 72 with an opening 73 to allow the insertion of the image or color film 35. This is held together with a plurality of screws 74 and an additional set of screws 75 are used to hold each of two 2032 batteries or other batteries 25 that are well known in the art. The image 35 is primarily introduced to the portable illuminated display device 10 by insertion. However, a message could be adhered to the cover surface 46 of the portable illuminated display device 10 by either adhering a plastic material with the message on the plastic material to the cover surface 46 or by direct printing the message on the cover surface 46. The portable illuminated display device 10 has 2 blinking modes and 1 full on mode. Another embodiment of the portable illuminated display device 10 has a 3 mode approach. The portable illuminated display device 10 can have multiple light modes involving blinking, reduced power, full power and light phasing.

There is a simple ON/OFF push button 85 on the back panel 80. There are two light levels: 100% and approximately 60%, although there are other light levels that can be set that are well known in the art. The casing 70 also has an attached easel 90 to allow for stand-alone use on a flat surface. There are also magnets 92 and a metal plate 94 which allow a user to attach the portable illuminated display 10 to clothing. Lastly there is both a vertical and horizontal attachment point 96 for the use of a lanyard.

The portable illuminated display 10 can be used in a commercial environment such as a bar or restaurant and can convey advertising either of the establishment itself or for a featured supplier, such as with an alcoholic beverage or food item. It can be used as a name badge at a convention or party or as a VIP name tag and scan able badge at concerts and other special events, to identify employees and volunteers. The portable illuminated display 10 can be used as a place holder for a wedding or other event, displaying the event and the names of the people who are to sit at seats at the event. The portable illuminated display 10 can also be used as a security identifier in a darkened room or stadium allowing attendees to quickly find help in an emergency. The portable illuminated display 10 can also be used as a source of ambient light in order to provide a night light or reading light in a dark restaurant. Other uses of the portable illuminated display 10 include enhancing identification of care personnel to those with limited vision, using as temporary signage such as "Do Not Touch" and "No Smoking", as a gift tag, greeting or ornament and as a source of light for a user to be seen in low light.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A portable illuminated display device; comprising:

a plurality of light emitting diodes (LEDs) that provides light to said device;

a substrate that is lit by said LEDs;

a plurality of batteries that power said display;

an image that includes a message or other indicia that is displayed and illuminated by said device;

a color insert that can change said LEDs light color;

a core that includes an electronics component with an integrated circuit that allows two levels of light to be used by said LEDs;

a light panel that receives said light from said LEDs and provides a homogenous area of light;

a cover with a cover surface that is disposed in front of said light panel to protect said light panel;

a casing with a back includes a back lid, a front lid, an opening between said lids to allow insertion of said image into said casing, an attached easel to allow for stand-alone use on a flat surface and a vertical and horizontal attachment point to accommodate a lanyard;

an on and off push button disposed on said back of casing to turn said device on and off; and a metal plate and a plurality of magnets to allow a user to attach said device.

2. The device according to claim 1, wherein said image can be replaced with a second image or affixed permanently.

3. The device according to claim 1, wherein said image can be a color film.

4. The device according to claim 1, wherein said light panel is covered with Mylar style material.

5. The device according to claim 1, wherein said light panel is made of a pixilated piece of plastic that provides a homogenous area of light.

6. The device according to claim 1, wherein said user can write on said cover surface.

7. The device according to claim 6, wherein said writing conveys a simple message.

8. The device according to claim 6, wherein said writing is done with a dry erase marker.

9. The device according to claim 1, wherein said device can be used in a commercial environment such as a bar or restaurant and can convey advertising either of the establishment itself or for a featured supplier.

10. The device according to claim 9, wherein said advertising advertises an alcoholic beverage or food.

11. The device according to claim 1, wherein said device can be used as a name badge at a convention or party.

12. The device according to claim 1, wherein said device can be used as a VIP name tag and scan able badge at concerts and other special events, to identify employees and volunteers.

13. The device according to claim 1, wherein said device can be used as a place holder for a wedding or other event, displaying said event and names of people who are to sit at seats at said event.

14. The device according to claim 1, wherein said device can be used as a security identifier in a darkened room or stadium allowing attendees to quickly find help in an emergency.

15. The device according to claim 1, wherein said device can be used as a source of ambient light in order to provide a night light or reading light in a dark restaurant.

16. The device according to claim 1, wherein said device can enhance identification of care personnel to those with limited vision.

17. The device according to claim 1, wherein said device can be used as temporary signage.

18. The device according to claim 17, wherein said temporary signage includes does not touch and no smoking signage.

19. The device according to claim 1, wherein said device as a gift tag, greeting or ornament.

20. The device according to claim 1, wherein said device is a source of light for said user to be seen in low light.

* * * * *